United States Patent [19]

Sanders

[11] Patent Number: 4,969,505

[45] Date of Patent: Nov. 13, 1990

[54] VACUUM BORE CHILL FOR LOST FOAM CASTING

[75] Inventor: Gregory Sanders, Plymouth, Mich.

[73] Assignee: General Motors Corporation, Detroit, Mich.

[21] Appl. No.: 454,585

[22] Filed: Dec. 21, 1989

[51] Int. Cl.[5] ..... B22C 9/04; B22D 27/15

[52] U.S. Cl. ..... 164/253; 164/61; 164/34

[58] Field of Search ..... 164/61, 34, 35, 253, 164/254, 353

[56] References Cited

U.S. PATENT DOCUMENTS

| | | | |
|---|---|---|---|
| 3,557,867 | 1/1971 | Kryzanowski | 164/255 |
| 3,581,802 | 6/1971 | Krzyanowski | 164/34 |
| 3,741,281 | 6/1973 | Hauser-Lienhard | 164/253 |
| 3,861,447 | 1/1975 | Hondo | 164/34 |
| 4,139,045 | 2/1979 | Vitt | 164/34 |
| 4,520,858 | 6/1985 | Ryntz, Jr. et al. | 164/34 |
| 4,706,732 | 11/1987 | Ruhlandt et al. | 164/253 |

*Primary Examiner*—Kuang Y. Lin

*Attorney, Agent, or Firm*—Douglas D. Fekete

[57] ABSTRACT

A vacuum chill device is provided for reducing porosity in a bore wall of a lost foam metal casting. In a preferred embodiment, the chill device is attached to a vaporizable pattern formed of polystyrene or the like and includes a vacuum chamber received in a bore defined by the pattern. The pattern and chill device are embedded in a body of unbonded sand particles or the like, whereupon the refractory body extends therebetween. The vacuum chamber is connected to a vacuum line that leads outside the mold and includes screened orificies through which the vacuum chamber communicates with the surrounding refractory body. During casting, pattern decomposition vapors venting into the bore are drawn through the orifices into the vacuum chamber and exhausted through the vacuum line. Removal of the hot vapors from the bore by the vacuum device accelerates solidification of the bore wall to reduce shrink porosity therein.

3 Claims, 2 Drawing Sheets

VACUUM BORE CHILL FOR LOST FOAM CASTING

BACKGROUND OF THE INVENTION

This invention relates to a lost foam casting process for making a metal casting having a bore defined by pore-free metal. More particularly, this invention relates to a vacuum chill device receivable within a bore of a vaporizable pattern employed in lost foam casting, which device withdraws pattern decomposition vapors from the bore during casting to accelerate solidification of metal about the bore and thereby reduce porosity in the bore wall.

A foundry mold for a lost foam metal casting process comprises an expendable pattern embedded in a body of unbonded sand particles. Molten metal is cast into the mold to decompose and replace the pattern, whereafter the metal solidifies to form a product casting that duplicates the pattern. The pattern is formed of a polymeric foam material, such as expanded polystyrene, that vaporizes at metal casting temperatures. Thus, the casting process is accompanied by generation of voluminous pattern decomposition vapors that vent into the surrounding sand body. Pattern decomposition vapors that do not vent may become entrapped in the metal and form pores. Also, the metal may exhibit shrink microporosity resulting from thermal contraction during solidification.

Ryntz et al U.S. Pat. No. 4,520,858, issued to in 1985, shows a lost foam casting process wherein a chill member is adhesively bonded to the pattern prior to casting. The chill preferentially accelerates solidification of metal in the adjacent casting region to reduce shrink porosity therein.

A principal advantage of the lost foam process is the duplication of bores in the product casting without special coring. A bore formed in the pattern fills with sand when the pattern is embedded in the mold, whereafter pattern replacement metal is shaped against the sand to define a bore in the product. Porosity is also a problem in bore walls of lost foam castings. Ruhlandt et al U.S. Pat. No. 4,706,732, issued to in 1987, shows a chill device for insertion into a bore. The chill device comprises fins that contact the bore wall and extract heat to reduce shrink porosity. The fins are spaced apart to provide channels for venting pattern decomposition vapors to avoid entrapment that might otherwise result in porosity.

It is known to apply a vacuum to the mold during lost foam casting to facilitate removal of pattern decomposition vapors. The vacuum has heretofore been applied to the mold generally, for example, through a plenum communicating with the mold through a screen bottom wall and is alternately used to inject air upwardly through the sand bed to fluidize the sand particles for embedding a pattern or removing a casting. It has now been found that preferential removal of pattern decomposition vapors from sand regions within a bore is effective to accelerate solidification of the metal cast thereabout in a manner similar to a chill member, and thereby reduces shrink porosity in the bore wall.

Therefore, it is an object of this invention to provide an improved lost foam casting mold comprising a vaporizable pattern embedded in an unbonded particulate body and having a bore for shaping a corresponding bore in a product casting, which mold further comprises means for preferentially removing pattern decomposition vapors from within the bore during casting to not only avoid entrapment, but also to accelerate solidification of cast metal about the bore relative to remote sections of the casting, to thereby reduce porosity in the bore wall, including in particular shrink microporosity.

SUMMARY OF THE INVENTION

In a preferred embodiment of this invention, a vacuum bore chill device is assembled with a vaporizable pattern having a bore wall prior to embedment in a bed of unbonded refractory particles in preparation for lost foam casting. The device comprises a vacuum chamber that is receivable within the bore spaced apart from the pattern wall. The chamber communicates with the surrounding refractory particulate body through screened orifices suitable for admitting vapors into the chamber but restraining sand particles. The device includes locating surfaces that are press fit against the pattern to position the chamber within the bore and to attach the device to the pattern for convenient handling. The locator surfaces are formed of a suitable metal or other material that does not fuse to the cast metal during casting, so that the device is readily disassembled from the product casting. A vacuum line connected to a remote vacuum pump communicates with the chamber for withdrawing pattern decomposition vapors therefrom during casting.

For casting, the vacuum chill device is attached to the pattern, and the resulting assembly is embedded in a particulate refractory body to form a foundry mold. The assembly may be embedded either by immersing the assembly into a bed of the particles fluidized by upward air flow, whereafter the air flow is discontinued to pack the bed about the pattern, or by positioning the assembly within an empty foundry flask and raining particles into the flask. After the pattern is embedded, the refractory body extends into the bore between the device and the pattern wall. Molten metal is poured into the mold in contact with the pattern to decompose and replace the pattern including the bore wall. This is accompanied by generation of voluminous pattern decomposition vapors that vent into interstices within the particulate body, including within the bore. In accordance with this invention, pattern decomposition vapors venting within the bore are drawn through the orifices into the vacuum chamber of the device and thereafter exhausted through the vacuum line. It is found that elimination of the vapors from the bore by the device accelerates solidification of pattern replacement metal at the bore wall in a manner substantially similar to a chill member. Thus, the casting produced using a vacuum chill device in accordance with this invention features a bore wall characterized by reduced porosity, not only attributed to the elimination of potentially entrappable vapors, but also due to the accelerated cooling that promotes directional solidification to feed shrinkage at the bore wall.

DESCRIPTION OF THE DRAWINGS

The present invention will be further described with reference to the accompanying drawings wherein.

DETAILED DESCRIPTION OF THE INVENTION

Figure 1:
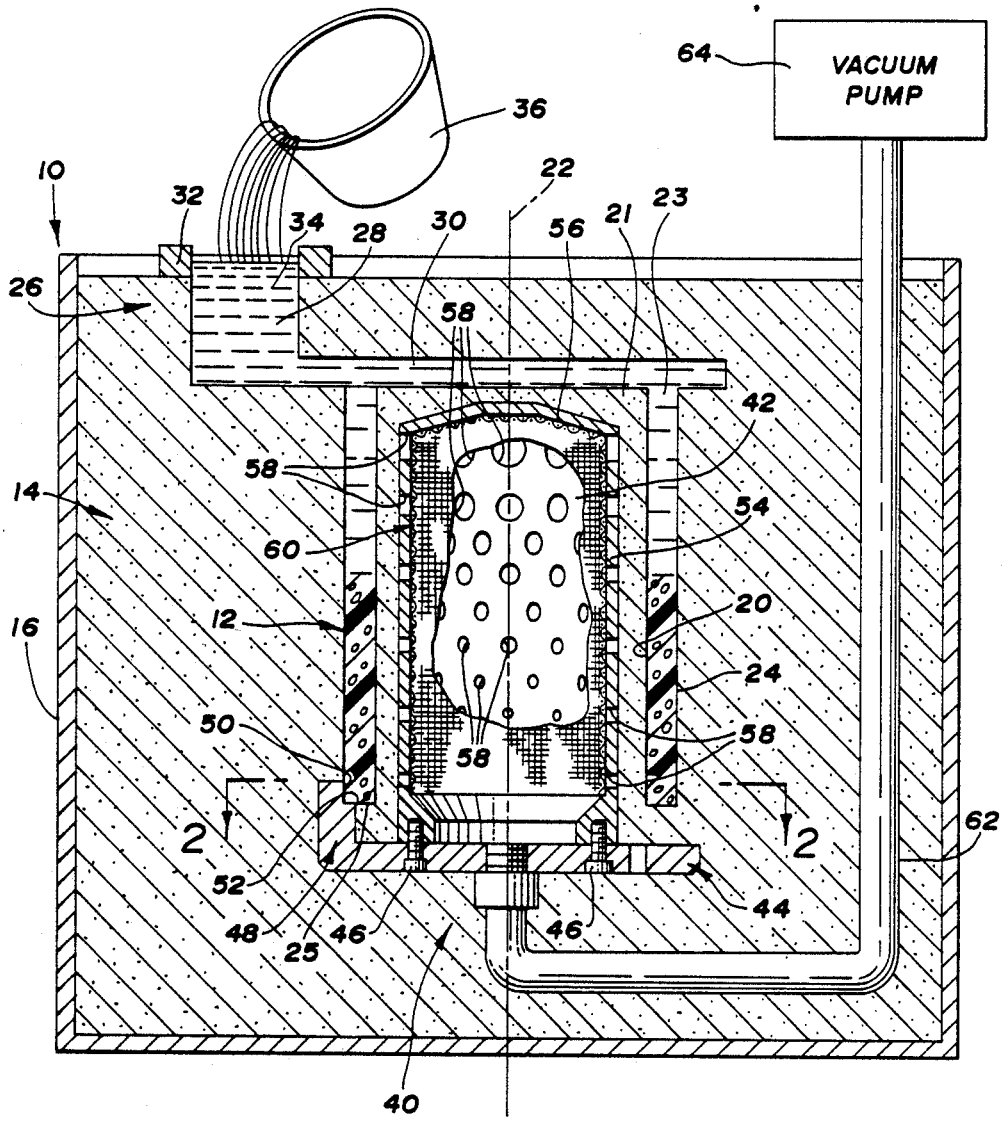
FIG. 1 is a cross-sectional view of a lost foam foundry mold, depicted during casting operations, comprising an expendable pattern in combination with a vacuum chill device in accordance with this invention.
Figure 2:
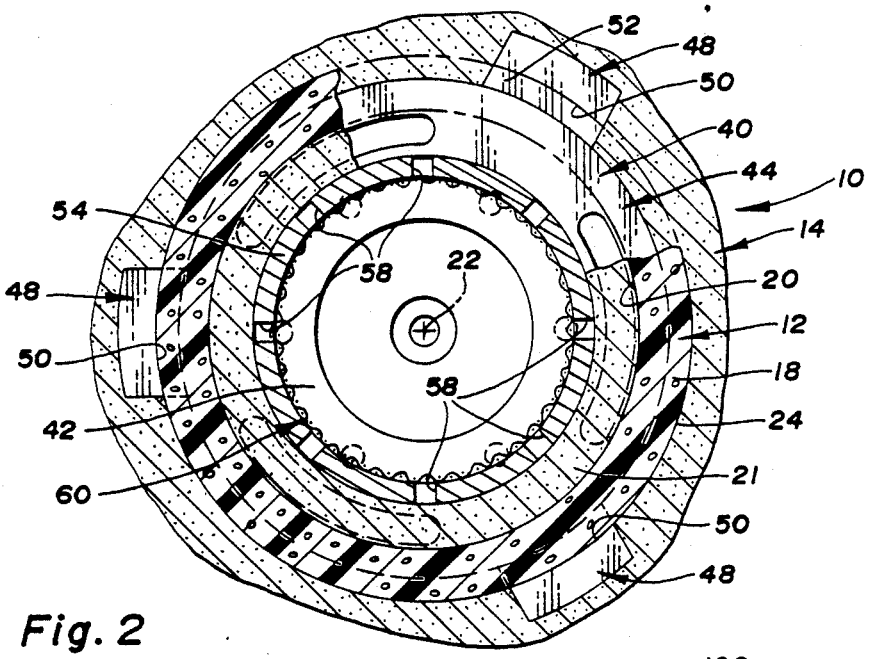
FIG. 2 is a cross-sectional partial view of the foundry mold in FIG. 1 taken along line 2—2 looking in the direction of the arrows and showing more particularly the vacuum chill device.

Referring to FIGS. 1 and 2, there is depicted a foundry mold 10 for casting metal by a lost foam process. Mold 10 comprises a pattern 12 formed of expanded polystyrene material that is vaporizable at metal casting temperatures. Mold 10 further comprises a body 14 composed of unbonded silica sand particles packed about pattern 10 and contained in a flask 16. Pattern 12, which is illustrated partially consumed during casting operations, comprises a tubular cylindrical product portion 18 suitable for producing a cylinder liner of a type that is fit into a cylinder bore of an automotive internal combustion engine to form a combustion chamber peripheral wall. Product portion 18 features an inner wall 20 defining a bore cylindrical about an axis 22, a concentric outer wall 24 and open ends 23 and 25. Pattern 12 further comprises a runner system 26, also composed of expanded polystyrene material but illustrated replaced by metal during casting. Runner system 26 comprises a downsprue 28 that protrudes above sand body 14 and is encircled by a pour cup 32 for receiving a charge of molten metal 34 poured from a ladle 36 during casting. A runner 30 laterally extends from downsprue 28 and is connected to product portion end 23 at diametrically opposed sites, bridging bore 21, for conveying pattern replacement metal from downsprue 28 to product portion 18.

In accordance with this invention, a vacuum chill device 40 is assembled with pattern 12 in mold 10. Vacuum chill device 40 comprises a cylindrical vacuum chamber 42 coaxially receivable in bore 21 spaced apart from pattern wall 20. Chamber 42 is mounted on a circular end plate 44 by screws 46. End plate 44 comprises three equiangularly-spaced notched prongs 48 for attachment of device 40 to pattern 12 in the desired coaxial orientation. Prongs 48 include axial locating surface 50 for engaging pattern outer wall 24 for accurate radial placement of device 40 and further comprise radial locating surfaces 52 for engaging pattern end surface 24 for accurate axial placement of device 40. The polystyrene material of pattern 12 is suitably resilient for press fitting pattern wall 24 against locating surface 50 for attaching vacuum chill device 40 to pattern 12 to form an integral assembly for convenient handling. Furthermore, plate 44 including integral prongs 48 are formed of a metal that does not fuse to the cast metal during casting, so that device 40 may be readily separated from a product casting.

Vacuum chamber 42 comprises a coaxial, cylindrical peripheral wall 54 sized for insertion into bore 21 spaced apart from bore wall 20 and has a closed end 56 opposite plate 44. Wall 54 comprises a plurality of orifices 58 for admitting pattern decomposition vapors to chamber 42 during casting. As can be seen, the sizes of orifices 58 vary axially such that the orifices are relatively larger adjacent closed end 56 and are progressively smaller toward plate 54. In this embodiment, it is found that this progressive orifice-size variation produces more uniform vapor removal during casting by providing larger orifices adjacent the first replaced region of the pattern wall that is farther from the vacuum connection through plate 44. The interior of chamber 42 is lined by a screen 60 that overlies orifices 58 for retaining sand particles from entering chamber 42. Chamber 42 communicates with a vacuum line 62 coaxially connected through plate 44, which line is in turn connected to a remote vacuum pump 64.

In preparation for casting, pattern 12 is made by adhesively bonding separately molded parts into the desired pattern configuration. Vacuum chill device is press fit about product portion end 25 to provide a convenient assembly. The assembly is positioned within empty flask 16, whereafter unbonded sand is rained into the flask, preferably accompanied by vibration, to pack the sand about the pattern assembly. Sand also packs bore 21 between pattern bore wall 20 and chamber wall 54. Immediately prior to casting, vacuum pump 64 is actuated to withdraw gas from chamber 42. A charge of metal 34 is poured from ladle 36 into pour cup 32 and against sprue 34, whereupon the metal progressively decomposes and replaces downsprue 28, runner 30 and eventually product pattern portion 18. Decomposition of the pattern by the progressive melt front is accompanied by generation of voluminous vapors that vent into sand body 14 including the sand body within bore 21. Vapors venting into bore 21 are drawn through orifices 58 into chamber 42 and thereafter through vacuum line 62 to pump 64. Thereafter, device 40 continues to vent gases from bore 21, which in turn draws cooler gases from remote regions of sand body 14, including air from above the upper surface thereof, to further enhance cooling of the bore wall. After product portion 18 has been replaced, the molten metal cools and solidifies to produce the product casting. The casting is removed from the sand body, whereafter chill device 40 is readily separated from the casting. Removal of chill device 40 from the casting is facilitated by the absence of substantial contact, such as through fins, between the chill device and the bore wall, the contact between device 40 and the casting being limited to locating surfaces 50 and 52. Following removal, device 40 is suitable for reuse with another pattern 12 for producing another casting.

Microscopic examination of the casting has demonstrated that, as a result of vapor removal, metal initially solidifies adjacent bore wall 20 and progressively outward toward outer wall 24. This radial directional solidification results in reduced porosity at bore inner wall 20. Castings produced with similar patterns 12, with or without vacuum chill device 40 in accordance with this invention, have not typically suffered from macroporosity due to entrapped vapors, in part because of the relatively large bore volume available to accommodate the displaced vapors exhausted from the bore wall. However, comparable castings of pattern 12 made without vapor removal in accordance with this invention tend to exhibit significant shrink porosity at the inner wall, as well as the outer wall. The inner wall porosity is attributed to retarded solidification due to the lingering of hot pattern decomposition vapors. By evacuating vapors from the bore, and thereby removing the heat contained in the vapors, it is found that the vacuum chill device is effective to accelerate bore wall solidification and reduces shrink porosity an average of 44 percent compared to lost foam casting of similar patterns made without the vacuum chill device.

Figure 3:
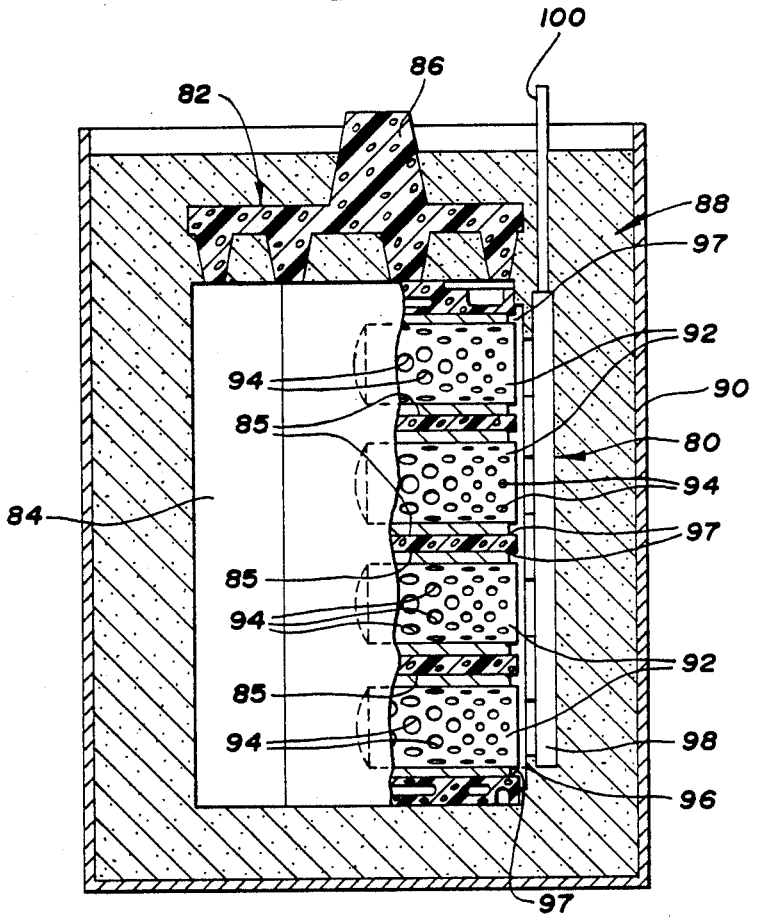
FIG. 3 is a cross-sectional view of a lost foam foundry mold showing an alternate embodiment of this invention wherein a vacuum chill device is employed in combination with an expendable pattern for casting an engine block casting.

Referring now to FIG. 3, there is shown an alternate embodiment of this invention wherein a vacuum chill device 80 is adapted for reducing porosity in cylinder walls of an engine block casting. For this purpose, an expanded polystyrene pattern 82 comprises an engine block pattern 84 and further comprises a runner system 86 for conveying cast metal to decompose and replace engine block pattern 84. Engine block pattern 84 comprises four cylindrical bores 85 for forming combustion cylinder bores. In this example, the cylinder bores are aligned in a configuration typical of an L-4 automotive engine. Prior to embedding pattern 84 in an unbonded sand body 88, vacuum chill device 80 is assembled with the pattern. Vacuum chill device 80 comprises four vacuum chambers 92 arranged such that each chamber 92 is coaxially receivable in a cylinder bore 85 but spaced apart therefrom by sand body 88. Chambers 92 comprise screened orifices 94 for admitting pattern decomposition vapors during casting. Each chamber 92 is affixed at one end to a mounting plate 96 having locating surfaces 97 for press fitting vacuum chill device 80 to pattern 82. Whereas locating surfaces 50 and 52 of vacuum chill device 40 in Figures 1 and 2 abut the outer wall and end surfaces of the cylindrical form, locating surfaces 97 fit against the inner wall 85, as well as the end surface, for accurate radial and axial placement of vacuum chill device. Also, each chamber 92 is connected to a manifold 98 that is in turn connected to a vacuum line 100.

During casting, metal is poured into contact with runner system 86 and progressively decomposes and replaces runner system 86 and thereafter engine block pattern 84. Pattern decomposition vapors generated during replacement of bore walls 85 vent into the adjacent sand body and are withdrawn into chamber 92 through orifices 94, and thereafter from plenum 92 into manifold 98 and are exhausted from manifold 98 through vacuum line 100. Removal of vacuum decomposition vapors from the sand body adjacent bore wall 85 accelerates solidification of the replacement metal adjacent the bore wall and directionally away therefrom to reduce microporosity in the solidified bore wall.

In the described embodiments, this invention provides a vacuum chill device receivable in a bore of a vaporizable pattern to withdraw pattern decomposition vapors generated during casting and thereby reduce porosity in the resulting cast metal wall. The vacuum chill device communicates directly with the sand body within the bore to preferentially remove vapors from sand body within the bore, in comparison to regions of the sand body outside the bore. The removal of hot pattern decomposition vapors from within the bore, combined with the retarded migration of hot vapors from the sand body about the pattern, is particularly effective to produce directional solidification within the relatively thin cross sectional walls of the casting. This directional solidification allows shrinkage in the early solidifying metal adjacent the bore wall to be fed by still-molten remote metal, resulting in reduced porosity. This invention may also be used in combination with a system for applying a vacuum to the sand body remote from the bore, such as through a screened wall of the foundry flask, to draw vapors generally from the vicinity of the pattern during casting. The proximity of the vacuum chill device accelerates vapor removal from within the bore to enhance solidification of the adjacent cast metal and thereby reduce porosity in the bore wall.

While the described examples feature cylindrical bores, this invention is suitable for use with bores of other shapes and sizes to metal porosity in the cast bore wall. As used herein, 'bore' refers to a hollow substantially enclosed by the pattern and intended to form a correspondingly shaped and sized bore in the product casting. This invention may be readily adapted by configuring the vacuum chamber to be received with a noncylindrical bore, such as a bore having noncircular cross sections, so as to suitably communicate with the sand body therein for withdrawing vapors therefrom during casting.

While this invention has been described in terms of certain embodiments thereof, it will be appreciated that other forms could be readily adapted by those skilled in the art. Accordingly, the scope of the invention is to be considered limited only by the following claims.

The embodiments of the invention in which an exclusive property or privilege is claimed are defined as follows:

1. In a foundry mold for casting metal by a lost foam process, said mold comprising an unbonded refractory particulate body and a vaporizable pattern embedded in the particulate body and replaceable by cast metal to form a product casting, whereupon pattern replacement is accompanied by generation of pattern decomposition vapors that vent into the particulate body, said pattern having a wall defining a bore, said particulate body extending within the pattern bore to shape cast metal to form a corresponding bore wall in the product casting,. the improvement comprising vapor withdrawal means communicating directly with the particulate body within the bore for withdrawing pattern decomposition vapors generated by metal replacement of the pattern bore wall during casting, whereby withdrawal of said vapors from the bore accelerates solidification of pattern replacement metal immediately about the bore to reduce porosity in the product casting bore wall.

2. In a foundry mold for casting metal by a lost foam process, said mold comprising a body of unbonded sand particles and a vaporizable polystyrene pattern embedded in the sand body for duplication by cast metal such that the cast metal vaporizes and replaces the pattern to form a product casting, said pattern having a wall defining a bore, said sand body extending into said bore against said pattern wall for shaping pattern replacement metal to form a corresponding bore wall in the product casting, the improvement comprising a vacuum chill device attached to said pattern and comprising a vacuum chamber received within the bore spaced apart from the pattern bore wall by the sand body, said vacuum chamber communicating with the sand body adjacent the pattern bore wall for withdrawing pattern decomposition vapors venting into the sand body during cast metal replacement of the pattern bore wall to accelerate solidification of the replacement metal immediately about the bore to reduce porosity in the product casting bore wall.

3. In a foundry mold for casting metal by a lost foam process, said mold comprising a body of unbonded sand particles and a vaporizable polystyrene pattern embedded in the sand body for replacement by metal to form a product casting, whereupon pattern decomposition vapors are generated during casting and vent into the sand body, said pattern having a wall defining a bore, said sand body extending into said bore against said pattern wall for shaping pattern replacement metal to form a corresponding bore wall in the product casting, the improvement comprising a vacuum chill device attached to said pattern and comprising a vacuum chamber received within the bore, said chamber comprising a peripheral wall proximate to the pattern bore wall but spaced apart therefrom by the sand body and having a plurality of screened orifices for admitting pattern decomposition vapors from the sand body into the vacuum chamber, and vacuum means for withdrawing vapors from the vacuum chamber such that pattern decomposition vapors venting from the bore wall into the adjacent sand body during casting are drawn into the vacuum chamber through the orifices to accelerate solidification of the replacement metal immediately about the bore to reduce porosity in the product casting bore wall.

* * * * *